US005118533A

United States Patent [19]

Saji et al.

[11] Patent Number: 5,118,533

[45] Date of Patent: Jun. 2, 1992

[54] METHOD OF MANUFACTURING COATED PAPER

[75] Inventors: Soichi Saji; Teruo Nakamura; Akira Takada, all of Amagasaki, Japan

[73] Assignee: Kanazaki Paper Mfg. Co., Ltd., Tokyo, Japan

[21] Appl. No.: 406,705

[22] Filed: Sep. 13, 1989

[30] Foreign Application Priority Data

Sep. 14, 1988 [JP] Japan ..... 63-233296

[51] Int. Cl.[5] ..... B05D 3/12

[52] U.S. Cl. ..... 427/366; 427/361; 427/391; 427/364

[58] Field of Search ..... 427/366, 361, 364, 365, 427/285, 391

[56] References Cited

U.S. PATENT DOCUMENTS

| | | | |
|---|---|---|---|
| 3,963,820 | 6/1976 | Blakey | 427/366 |
| 4,012,543 | 3/1977 | Ranger et al. | 427/366 |
| 4,134,872 | 1/1979 | Lee | 427/391 |
| 4,241,143 | 12/1980 | Ashie | 427/366 |
| 4,265,969 | 5/1981 | Yasuda | 427/391 |
| 4,370,389 | 1/1983 | Ogura | 427/361 |
| 4,381,365 | 4/1983 | Mishiba et al. | 525/902 |
| 4,423,118 | 12/1983 | Corbett et al. | 427/391 |
| 4,477,535 | 10/1984 | Sinclair et al. | 427/391 |
| 4,613,633 | 9/1986 | Sekiya et al. | 427/391 |
| 4,978,560 | 12/1990 | Stone | 427/366 |

*Primary Examiner*—Michael Lusignan
*Assistant Examiner*—Diana L. Dudash
*Attorney, Agent, or Firm*—Flynn, Thiel, Boutell & Tanis

[57] ABSTRACT

A high quality coated paper for printing having excellent smoothness, gloss and printability is provided by using a coating composition mainly composed of a pigment and a latex of heterogeneous polymer particles consisting of a hard polymer domain having a glass transition temperature of 80° to 220° C. and a soft polymer domain having a glass transition temperature of 25° to 95° C. in combination with a high temperature calender finishing.

5 Claims, No Drawings

METHOD OF MANUFACTURING COATED PAPER

BACKGROUND OF THE INVENTION

This invention relates to a method of manufacturing high quality coated paper for printing and, more particularly, to a method of manufacturing a high quality coated paper for printing, which has excellent smoothness, gloss and printability, by using latexes of particular heterogeneous polymer particles as an ingredient of the coating composition and high temperature calenders.

Recently, there has been an increasing demand for improving the gloss, visual gloss, smoothness, ink receptivity and ink gloss of the coated surface of coated paper for printing to meet a trend for visualization of print, color printing and high quality printing. In fact, various processes for manufacturing coated paper for printing have been proposed.

For example, a multi-layer coating process using a blade coater has been proposed, and in a finishing step there has been proposed the use of a high temperature calender maintained at 100° C. or more (as disclosed in, for example, U.S. Pat. No. 4,241,143 and Japanese Patent Publication No. 49-21252). Moreover, it is known to use, as pigments of a coating composition, fine particles such as satin white, ultra-fine ground calcium carbonate, fine cubic precipitated calcium carbonate, delaminated kaolin, calcined kaolin, fine talc and plastic pigments or to apply a concentrated coating composition having a solid content of 65 wt % or more to a base paper. However, according to these prior art methods, it is impossible to obtain a high quality coated paper which has excellent gloss, visual gloss and smoothness and further has excellent printability, including ink receptivity and ink gloss.

A method for manufacturing coated print paper having high gloss is well known in the art. For example, one method comprises the steps of coating an aqueous coating composition mainly composed of a pigment and an adhesive on base paper, drying the coated layer on the paper and then finishing it with a gloss calender at a high temperature. There is used kaolin, satin white, calcium carbonate, plastic pigment, etc. as the pigment component of the composition and a polymer latex with a glass transition temperature (hereinafter referred to as Tg) of 38° C. or more is used as the adhesive component of the composition. The coating layer is dried at a temperature lower than the Tg of the polymer latex and then finished at a temperature higher than the Tg (as disclosed in, for example, U.S. Pat. Nos. 4,265,969 and 4,241,143). However, with a coating composition containing a polymer latex and a plastic pigment, the content of The adhesive should be greatly increased as compared with the case of using kaolin or the like because the particle diameter of the plastic pigments is usually as small as 0.6 micron. More specifically, the composition should contain at least 12 wt % of plastic pigment in order to obtain improvements in gloss or visual gloss by the use of the plastic pigment. In this case, it is necessary to use an adhesive in an amount of 20 wt % or more on the basis of the solid content of the coating composition. This means that the sum of the amounts of the plastic pigment and adhesive exceeds 32 wt % of the solid content of the coating composition, that is, the proportion of expensive materials is very high. In addition, a coating composition using a polymer latex as an adhesive component spoils the operation of the coater due to the fact that a coating layer containing a polymer latex should be dried at a temperature which does not result in the forming of a polymer latex film. For the above reasons, the coating composition as mentioned above is hardly used in practice in the manufacture of coated paper.

For the purpose of improving the gloss of coated paper, there has been proposed a process which comprises the steps of applying to a base paper a coating composition containing a copolymer latex of heterogeneous polymer particles composed of a core polymer and a shell polymer, said core polymer having a Tg of 60° C. or more and not being film-forming under the drying conditions employed in the manufacture of the coated paper, said shell polymer being film-forming under said drying conditions and being able to form a continuous film at a normal temperature; drying the coating layer of the composition on the base paper; and then subjecting the dried coating layer to finishing with a supercalender (as disclosed in Japanese Patent Laid-Open No. 54-151606 and U.S. Pat. Nos. 4,381,365 and 4,613,633). However, where the core/shell type polymer latex as mentioned above is added to a coating composition used in coated paper production employing a finishing step with a high temperature calender at more than 100° C., as is intended by the present invention, the core polymer softens and unites with the shell polymer in the finishing step. Therefore, the use of the aforesaid heterogeneous polymer latex of the core/shell type does not produce a good result as compared with the use of a homogeneous polymer latex and it is impossible for it to satisfactorily improve the smoothness and gloss of the coated paper.

SUMMARY OF THE INVENTION

The inventors have conducted extensive researches and investigations concerning the functions of latexes of heterogeneous polymer particles contained in a coating composition which is used in a method for coating the aforesaid composition onto a base paper and finishing the coated paper by passing it through a calender at a high temperature of 100° C. or more. As a result, it is has been found that by using a latex of heterogeneous polymer particles, which consists of a hard polymer domain which does not fuse under high temperature and high pressure conditions in a process of manufacturing coated paper and a soft polymer domain which does not form a film at normal temperatures, in combination with a high temperature calender, the smoothness, gloss and visual gloss of the finished coated paper can be extremely improved, so that it is possible to obtain a high quality coated paper for printing not obtained by the prior art. The present invention is predicated in the above finding.

According to the invention, there is provided a process of manufacturing coated paper comprising the steps of coating an aqueous coating composition mainly composed of a pigment and an adhesive, on base paper, drying the coating layer on the paper and then finishing the coated paper with a calender at a surface temperature of at least 100° C., characterized in that said aqueous coating composition contains a latex of heterogeneous polymer particles in an amount of 10 to 40 wt % solid content on the basis of the weight of said pigment, said heterogeneous polymer particles having a hard polymer domain with a glass transition temperature of 80° to 220° C. and a soft polymer domain with a glass transition temperature at 25° to 95° C., the glass transition temperature difference between said hard polymer domain and said soft polymer domain being 20° C. or more.

The hard polymer domain, constituting heterogeneous polymer particles used according to the invention, has a function similar to that of pigment. It is important that the hard polymer domain has a Tg in the range of 80° to 220° C., preferably 90° to 200° C. The soft polymer domain, on the other hand, functions as an adhesive under high temperature and high pressure conditions, and has a Tg in the range of 25° to 95° C., preferably 30° to 90° C. It is also important that the soft polymer domain is non-film forming at normal temperature.

If the Tg of the hard polymer domain is below the lower limit of aforesaid range, the hard polymer domain is substantially softened and deformed in a supercalender finishing step performed at a high temperature of 100° C. or more, so that its function as a pigment can not be obtained. If the soft polymer domain forms a film at normal temperatures, the soft polymer domain and the pigment are firmly consolidated together at the time of the completion of the drying of the coating layer. It is thus impossible to orient pigment particles within the coating layer in a subsequent step of finishing with a high temperature calender. Therefore, it is impossible to obtain coated paper having excellent smoothness. Besides, the off-set ink transferability of the finished coated paper is impaired due to the fact that the coating layer on the paper forms a more perfect film in the high temperature calender finishing step. This trend is promoted when the content of the heterogeneous polymer particles in the coating composition exceeds 15 wt % of the weight of the pigment contained therein.

For the above reasons, in the case of carrying out the drying step and/or calender finishing step at a relatively high temperature, it is important to select a soft polymer domain having a relatively higher Tg, although the selection of the soft polymer domain strictly depends on the conditions employed for drying the coating layer, i.e., the temperature of the inside of the coating layer after the moisture in the coated paper is reduced to 10% or below, drying time and temperature and speed of the finishing calender. In other words, it is important to use such heterogeneous polymer particles as may consolidate but not completely from a film within the coating layer on the base paper during the drying thereof, the coating layer allowing the orientation of pigment particles therein during the high temperature calender finishing step and producing solid adhesion therein at the end of the finishing step. The soft polymer domain of the heterogeneous polymer particles according to the invention is selected on the basis of the particular conditions, including drying temperature and drying time, and paper quality after high temperature calender finishing. However, the drying time for reducing the moisture in the paper to 10% or below is usually only several seconds and, therefore, the drying temperature need not be made lower than the Tg of the soft polymer domain. It is preferable to maintain a temperature difference between the Tg of the hard polymer domain and that of the soft polymer domain of 20° C. or more.

DETAILED DESCRIPTION OF THE INVENTION

As has been described above, the heterogeneous polymer particles according to the invention should consist of hard and soft polymer domains having different Tg values. Their structure may be a core/shell structure, a salami structure or any other heterogeneous structure. The coating composition according to the invention contains a latex of the heterogeneous polymer particles in an amount of 10 to 40 parts, preferably 15 to 40 parts, more preferably 20 to 40 parts by weight solids per 100 parts by weight of pigment. If the content of the latex is below 10 parts by weight, the gloss, smoothness and visual gloss of the coated paper can not be improved. If the content exceeds 40 parts by weight, on the other hand, the ink receptibility of the coated paper is impaired in addition to the fact that such a high content is not suited in view of economy.

The heterogeneous polymer particle latex according to the invention is manufactured by a well-known seed polymerization method, in which the copolymerizable monomer component for the shell polymer or surface layer can be emulsion-polymerized in the presence of polymer particles as the core. In order that the copolymer component for the shell polymer is polymerized on core polymer particles to form heterogeneous polymer particles without formation of discrete particles independent from the core particles, the polymerization should be performed in the absence of any micelle of emulsifier in an aqueous phase. It is also possible to perform a step of producing core particles and a step of forming the surface layer of the particles may be performed continually after the core formation. In order that the obtained latex particles may attain the object of the invention, the average diameter of the heterogeneous polymer particles is preferably in the range of 0.1 to 0.6 micron. The proportions of the hard and soft polymer domains of the heterogeneous polymer particles are not particularly limited. However, it is particularly suitable that the former is from 40 to 90 wt % and that the latter is from 60 to 10 wt %.

The heterogeneous polymer particles latex according to the invention may be prepared by a process disclosed in U.S. Pat. Nos. 4,381,365 and 4,613,633.

Examples of monomer which may constitute the hard polymer domain are styrene, α-methyl styrene, 2-methyl styrene, 3-methyl styrene, 4-methyl styrene, 2,4-diisopropyl styrene, 2,4-dimethyl styrene, 4-t-butyl styrene, 5-t-butyl-2-methyl styrene, monochlorostyrene, dichlorostyrene, monofluorostyrene, hydroxymethyl styrene and other aromatic vinyl compounds; methyl methacrylate, ethyl methacrylate, isopropyl methacrylate, phenyl methacrylate, cyclohexyl methacrylate, 2-chloroethyl methacrylate, methyl chloroacrylate, ethyl chloroacrylate, butyl chloroacrylate; acrylonitrile, methacrylonitrile and other ethylenic nitrile compounds; vinyl chloride, acrylic acid, methacrylic acid, crotonic acid, cinnamic acid, itaconic acid, fumaric acid, maleic acid, butentricarboxylic acid, itaconic acid monobutyl ester and other unsaturated carboxylic acids and esters thereof. It is possible to use mixture two or more monomers in this group.

Further, monomers capable of forming a film-forming homopolymer, such as 1,3-butadiene, 2-methyl-1,3-butadiene, 2-chloro-1,3-butadiene and other aliphatic diolefins, methyl acrylate, ethyl acrylate, butyl acrylate, 2-ethylhexyl acrylate and other acrylic esters may be used as components for forming the hard polymer provided that the copolymer produced has a Tg of 80° C. or more. If necessary, hydrophilic monomers such as β-hydroxyethyl acrylate, β-hydroxypropyl acrylate, β-hydroxyethyl methacrylate, acrylamide, methacrylamide, N-methylolacrylamide, N-butoxymethyl acrylamide, glycidyl acrylate, glycidyl methacrylate, acrolein and allyl alcohol may be used together with the above-mentioned monomers. It is possible to increase the Tg of the hard polymer by the use of a crosslinking reaction.

As the monomer constituting the soft polymer domain, monomers heretofore used may be used for the polymer latexes for the coated paper, such as, aliphatic conjugate dienes, aromatic vinyl compounds, ethylenic unsaturated amides, ethylenic unsaturated carboxylic acids, acrylic monomers, ethylenic unsaturated nitrile compounds, alkenyl aromatic monomers, unsaturated carboxylic alkylester monomers, unsaturated monomers having hydroxyalkyl groups and vinyl cyanide monomers.

As the pigment incorporated in the coating composition according to the invention, there may be used conventional pigments for coated paper such as clay, kaolin, aluminium hydroxide, calcium carbonate, titanium dioxide, barium sulfate, zinc oxide, satin white, calcium sulfate, talc, plastic pigments and mixtures thereof.

The composition may contain other adhesives along with the heterogeneous polymer particles according to the invention. As other adhesives, there may be used conventional adhesives for coating compositions, such as, casein, bean protein, synthetic protein and other proteins; conjugate dienic copolymer latexes such as styrene-butadiene copolymers, methylmethacrylate-butadiene copolymers; acrylic polymer latexes such as polymers and copolymers of acrylate and/or methacrylate; vinylic polymer latexes such as ethylene-vinyl acetate copolymers; alkali-soluble or alkali-insoluble polymer latexes obtained by denaturing the above polymer latexes with monomers having functional groups, such as carboxyl groups; synthetic resin adhesives including polyvinyl alcohol, olefin-maleic anhydride resin and melamine resin; cationic starch, oxidized starch and other starches; and cellulose derivatives including carboxymethyl cellulose, hydroxyethyl cellulose and the like. If these adhesives are used excessively, however, the pigment component and adhesive component are firmly combined with each other at the time of the end of the drying process, so that the pigment component can no longer be satisfactorily oriented within the coating layer during the high temperature calender finishing step. It is therefore recommended to keep the content of the adhesives, other than the heterogeneous polymer particles, in an amount of 15 wt % or less, preferably 10 wt % or less, based on the weight of the pigment contained in the coating composition.

The coating composition according to the invention may further contain, if necessary, various auxiliary agents such as antifoamers, coloring agents, lubricants and fluidity modifiers. Further, as an agent for promoting solidification of the coating layer, the coating composition may contain amine, amide, polyacrylamine and multi-valent metal salts of zinc, aluminium, magnesium, calcium and barium in an amount of 0.1 to 10 wt %, based on the weight of the pigment.

The coating composition according to the invention is coated as a single layer, or multiple layers, on a base paper by a coater used in normal coated paper manufacture, such as, a blade coater, roll coater, brush coater, curtain coater, champlex coater, bar coater, gravure coater and size press coater. The amount of coating applied is suitably 5 to 30 g/m$^2$, preferably 15 to 25 g/m$^2$. As the base paper, there may be used a paper having a basis weight of 30 to 400 g/m$^2$ and which can be obtained from pulp compositions selected from bleached pulps, such as BLKP (Bleached Hardwood Kraft Pulp), BNKP (Bleached Softwood Kraft Pulp) and BCTMP (Bleached Chemithermomechahanical Pulp) and so called high yield pulps such as SGP (Stone Groundwood Pulp), PGP (Pressurized Stone Groundwood Pulp), TMP (themomechanical Pulp), RGP (Refiner Groundwood Pulp) and CTMP (Chemithermomechancial Pulp) by the use of a Fourdrinier paper machine, a Twin-wire machine, a board machine, etc., under acidic or neutral conditions. Further, single side gloss paper, on-machine undercoated paper, off-machine soft calender finished paper and other smoothed paper may also be suitably used.

The coating layer formed on the base paper is dried and then finished by a high temperature calender at 100° C. or more. The high temperature calender, such as gloss calenders, soft calenders and various other calenders comprising metal rolls or drums and elastic rolls, may be suitably used with an on- or off-machine. The surface of a metal roll may be treated by hard chromium plating, and its surface temperature is preferably held at a high temperature of 100° to 500° C. As the elastic roll, there may suitably be used resin rolls made of polyurethane, polyamide, phenol resin, epoxy resin, polyacrylate resin, vinylidene fluoride resin, etc. and rolls made from cotton, asbestos, nylon, aramid fiber, etc. A thermostable fiber, such as an aramid fiber and the like, is best suited for material made into the elastic roll.

The conditions employed during the use of the high temperature calender are adjusted depending on the kind of coated paper intended for production, base paper, characters of the coating layer, amount of coating, moisture of the paper, finishing speed and so on. It is preferable to maintain the surface temperature of the calender roll at a high temperature so as to promote plasticization of the coating layer, and it usually is adjusted to be in the range of 120° to 300° C. As the pressure condition of the calender roll, a linear pressure of 100 to 500 kg/cm, usually 150 to 350 kg/cm, is suitably maintained. The moisture of the coated paper prior to passing through the calender nip is desirably adjusted in the range of about 3 to 10%. The finishing speed of the calender is greatly influenced by the basis weight and quality of the paper but a finishing speed in the range of 200 to 1,600 m/min is preferred.

Of course, it is possible to adjust or control the moisture of the finished coated paper by passing it through a conventional humidifier of the type known in the art including a coater which applies water to the paper a roll, an electrostatic humidifier, a steam humidifier and a combination thereof.

PREFERRED EMBODIMENTS

Preferred examples of the invention will now be given below without any limiting of the invention. All parts and percentages in these examples are by weight unless otherwise specified. Table 1 shows compositions of latexes of the heterogeneous polymer particles used in the following examples.

TABLE 1

| Latex of heterogeneous polymer particles | A | B | C | D | E | F | G | H |
|---|---|---|---|---|---|---|---|---|
| Hard polymer domain | | | | | | | | |
| Butadiene | — | — | — | 16 | — | — | 2 | — |
| Styrene | 55 | 50 | 50 | 80 | 55 | 55 | 95 | 50 |
| α-Methyl styrene | — | — | 50 | — | — | — | — | 50 |
| Methyl methacrylate | — | 50 | — | — | — | — | — | — |
| Acrylonitrile | 42 | — | — | — | 42 | 42 | — | — |
| Itaconic acid | — | — | — | 4 | — | — | 3 | — |
| Methacrylic acid | 3 | — | — | — | 3 | 3 | — | — |
| Tg (°C.) | 108 | 91 | 130 | 60 | 108 | 108 | 85 | 130 |
| Average particle diameter (μ) | 0.30 | 0.35 | 0.21 | 0.30 | 0.30 | 0.30 | 0.30 | 0.30 |
| Soft polymer domain | | | | | | | | |
| Butadiene | 18 | 24 | 13 | 22 | 29 | — | 25 | — |
| Styrene | 78 | 75 | 84 | 75 | 41 | 98 | 61 | 52 |
| Methyl methacrylate | — | — | — | — | 17 | — | 10 | 48 |
| Acrylonitrile | — | — | — | — | 9 | — | — | — |
| Itaconic acid | 4 | 1 | 3 | 3 | 4 | 2 | 4 | — |
| Tg (°C.) | 52 | 32 | 75 | 33 | 15 | 100 | 26 | 92 |
| Average diameter of heterogeneous particle (μ) | 0.40 | 0.50 | 0.28 | 0.40 | 0.40 | 0.40 | 0.40 | 0.40 |

EXAMPLE 1

70 parts of kaolin (available under the trade name "UW-90", manufactured by EMC Inc.,), 20 parts of ultra-fine ground calcium carbonate (available under the trade name "Carbital 90", manufactured by Fuji Kaolin Co., Ltd.) and 10 parts as solids of satin white dispersion (available under the trade name "Satin White", manufactured by Shiraishi Kogyou Co., Ltd.) were mixed. 0.2 parts of sodium polyacrylate was added to the mixture and the resultant admixture was agitated using a Cowles dissolver to obtain a pigment slurry having a solids content of 66%.

To this slurry were added 2 parts of oxidized starch, 15 parts dry basis of latex (A) as shown in Table-1 and a proper quantity of water so that there is obtained an aqueous coating composition having a solids content of 56%. The coating composition thus obtained was coated by a blade coater unto both sides of a high quality base paper having a basis weight of 80 g/m$^2$, such that the dry weight of the coating on each side was 20 g/m$^2$, and dried using a drier having a surface temperature of 120° C. to obtain a double side coated paper with a moisture content of 6.5%. Then, it was finished using a soft compact calender with a metal roll surface temperature of 160° C., 4 nips, a linear pressure of 250 kg/cm and a speed of 300 m/min. The coated paper obtained in this Example was tested, and the results are shown in Table-2.

EXAMPLE 2

A coating composition was prepared in the same manner as in Example 1 except that 32 parts of latex (B) as shown in Table-1 was used in lieu of 15 parts of latex (A) and no oxidized starch was used. The coating composition thus obtained was coated by a blade coater unto both sides of a medium quality base paper having a basis weight of 40 g/m$^2$ in such a manner that its dry weight on each side was 13 g/m$^2$. The pulp composition of the base paper was 40 parts of NBKP (Softwood bleached kraft pulp), 10 parts of LBKP (hardwood bleached kraft pulp) and 50 parts of GP (ground pulp). Then, the coated paper was dried and finished in the same manner as in Example 1 except that the calender surface temperature was set to 120° C. The coated paper obtained was tested and results are shown in Table-2.

EXAMPLE 3

A double sided coated paper was obtained in the same manner as in Example 1 except that 25 parts of latex (C) shown in Table-1 was used in lieu of 15 parts of latex (A), no oxidized starch was used and the calender surface temperature was set to 210° C. The coated paper obtained in this Example was tested and the results are shown in Table-2.

EXAMPLE 4

A double sided coated paper was obtained in same manner as in Example 2 except that 20 parts of latex (G) shown in Table-1 was used in lieu of 32 parts of latex (B). The coated paper obtained in this Example was tested and the results are shown in Table-2.

EXAMPLE 5

A double sided coated paper was obtained in the same manner as in Example 3 except that 40 parts of latex (H) shown in Table-1 was used in lieu of 25 parts of latex (C). Table-2 shows the test results of the coated paper prepared in this Example.

CONTROL EXAMPLE 1

A double sided coated paper was obtained in the same manner as in Example 1 except that latex (D) shown in Table-1 was used in lieu of latex (A). Table-2 shows the test results of the obtained coated paper.

CONTROL EXAMPLE 2

A double sided coated paper was obtained in the same manner as in Example 1 except that 25 parts of latex (E) shown in Table-1 was used in lieu of 15 parts of latex (A). Table-2 shows the test results of the obtained coated paper.

CONTROL EXAMPLE 3

A double sided coated paper was obtained in the same manner as in Example 1 except that 25 parts of latex (F) shown in Table-1 was used in lieu of 15 parts of latex (A). Table-2 shows the test results of the obtained coated paper.

CONTROL EXAMPLE 4

A double sided coated paper was obtained in the same manner as in Example 1 except that 8 parts instead of 15 parts of latex (A) and 16 parts instead of 2 parts of oxidized starch were used. Table-2 shows the test results of the coated paper.

CONTROL EXAMPLE 5

A double sided coated paper was obtained in the same manner as in Example 3 by using 25 parts of a latex of homogeneous polymer having a Tg of 3° C. in lieu of latex (C). Table-2 shows the test results of the obtained coated paper.

TABLE 2

| | Ex. 1 | Ex. 2 | Ex. 3 | Ex. 4 | Ex. 5 | Cont. Ex. 1 | Cont. Ex. 2 | Cont. Ex. 3 | Cont. Ex. 4 | Cont. Ex. 5 |
|---|---|---|---|---|---|---|---|---|---|---|
| Coating Composition (parts) | | | | | | | | | | |
| Latex used | A | B | C | G | H | D | E | F | A | — |
| Amount of latex (dry basis) | 15 | 32 | 25 | 20 | 40 | 15 | 25 | 25 | 8 | — |
| Oxided starch | 2 | — | — | — | — | 2 | 2 | 2 | 16 | — |
| Latex of homogeneous polymer | — | — | — | — | — | — | — | — | — | 25 |
| Surface temperature of calender (°C.) | 160 | 120 | 210 | 120 | 210 | 160 | 160 | 160 | 160 | 210 |
| Coated paper-properties | | | | | | | | | | |
| paper gloss (%) | 84 | 86 | 88 | 82 | 90 | 79 | 80 | 84 | 65 | 75 |
| Ink receptivity | ◎ | ○ | ○ | ○ | ○ | Δ | x | ○ | ○ | x |
| Offset ink transferability | ◎ | ○ | ○ | ○ | ○ | x | x | ○ | ○ | x |
| Printing strength | ○ | ◎ | ◎ | ○ | ◎ | ◎ | ◎ | x | ○ | ◎ |

Note:
White paper gloss is measured according to TAPPI Standard Test T-480-om-85.
Ink receptivity is measured according to TAPPI Routine Control Method and evaluated by observation.
Off-set ink transferability is measured as follows:
By using an RI tester (made by Akira Seisakusho), water was coated on the surface of the coated paper by a molten roll, and solid printing was carried out on the surface by using an offset ink.
After the printing, the ink density transfered was evaluated visually.
Printing strength is measured as follows:
Three-fold overlapped printing was made on the surface of the coated with a offset ink by using RI tester, and peeling from the paper was evaluated visually.
Marks in table denote:
◎ . . . excellent.
○ . . . good.
Δ . . . fairly good.
x . . . poor As it is obvious from the results shown in Table-2, the coated paper manufactured by the process of the invention has excellent paper gloss, inkreceptivity and off-set ink transferability and sufficiently satisfactory printing strength.

What is claimed is:

1. A process of manufacturing coated paper comprising the steps of coating a base paper with an aqueous coating composition mainly composed of a pigment and an adhesive, said aqueous coating composition containing a latex of heterogeneous polymer particles in an amount of 10 to 40 wt. % as solids, based on the weight of the pigment, said heterogeneous polymer particles consisting of a hard polymer domain having a glass transition temperature of 80° to 220° C. and a soft polymer domain having a glass transition temperature of 30° to 90° C. and which does not form a film at normal temperature, the difference in glass transition temperature between the hard and soft polymer domains being 20° C. or greater;

drying said aqueous coating composition on said base paper to form a coated layer on said base paper; and passing the coated base paper through a calender having a surface temperature of 100° C. or greater to produce said coated paper.

2. The process according to claim 1, wherein said hard and soft polymer domain are contained in said heterogeneous polymer particles in an amount of 40 to 90 wt % and 10 to 60 wt %, respectively.

3. The process according to claim 1, wherein said aqueous coating composition contains an adhesive other than said latex of heterogeneous polymer particles in an amount of 0 to 15 wt % as solids based on the weight of the pigment.

4. The process according to claim 1, wherein said coating composition is coated on both sides of the base paper.

5. The process according to claim 4, wherein said aqueous coating composition is coated in an amount of 5 to 30 g/m$^2$ on each side of the base paper.

* * * * *